US005259094A

United States Patent [19]

Zepeda

[11] Patent Number: 5,259,094

[45] Date of Patent: Nov. 9, 1993

[54] SHOE LACING APPARATUS

[76] Inventor: Ramon O. Zepeda, 4338 St. Highway 84, Walnut Grove, Calif. 95690

[21] Appl. No.: 14,759

[22] Filed: Feb. 8, 1993

[51] Int. Cl.[5] ..... A43C 7/00

[52] U.S. Cl. ..... 24/712; 24/712.1; 24/712.5; 24/573.1; 36/50.1

[58] Field of Search ..... 24/712, 712.1, 712.2, 24/712.3, 712.4, 712.5, 713.1, 713.6, 715.1, 715.3, 714.6; 36/50.1

[56] References Cited

U.S. PATENT DOCUMENTS

| | | | |
|---|---|---|---|
| 2,673,381 | 3/1954 | Dueker | 24/712 |
| 3,103,725 | 9/1963 | Robb et al. | 24/712.5 |
| 3,500,508 | 3/1970 | Bennett | 24/712.2 |
| 4,393,550 | 7/1983 | Yang et al. | 24/712.5 |
| 4,870,761 | 10/1989 | Tracy | 24/712 |
| 4,967,454 | 11/1990 | Elieff | 24/712.1 |

FOREIGN PATENT DOCUMENTS

| | | | |
|---|---|---|---|
| 0265445 | 2/1927 | United Kingdom | 36/50.1 |

*Primary Examiner*—Victor N. Sakran
*Attorney, Agent, or Firm*—Leon Gilden

[57] ABSTRACT

A shoe lacing apparatus includes an elongate housing having a pull rod structure directed therethrough, with the pull rod in operative association with lateral hook members, with each hook member directed into a shoe lace opening of an associated shoe, whereupon tensioning of the pull rod and latching within the elongate housing effects the rapid lacing of the shoe structure.

5 Claims, 4 Drawing Sheets

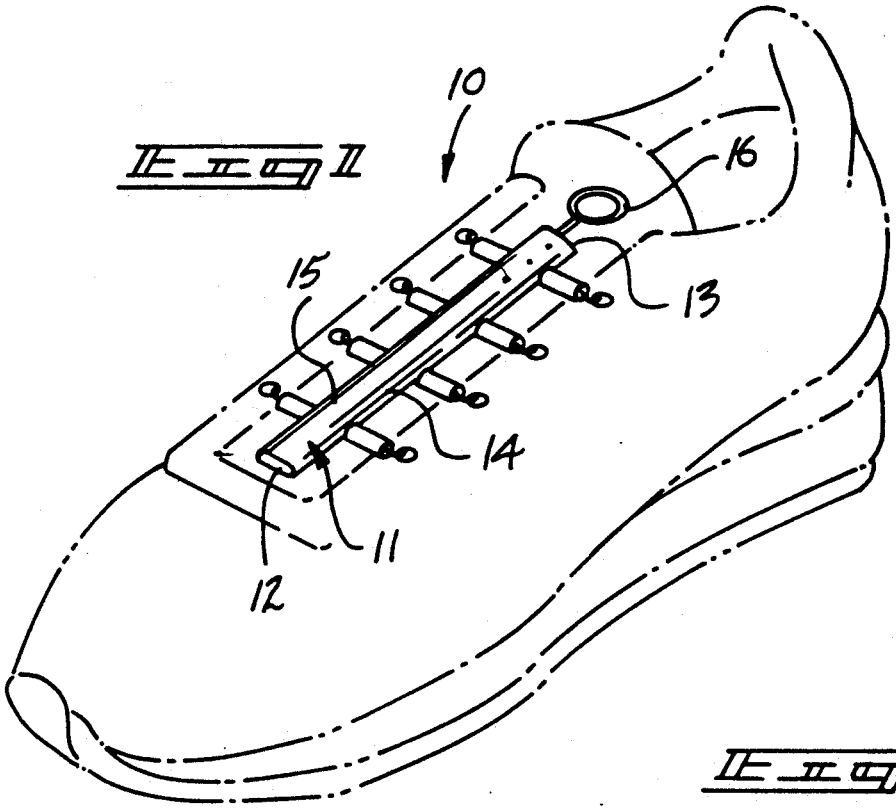
FIG 1
FIG 2
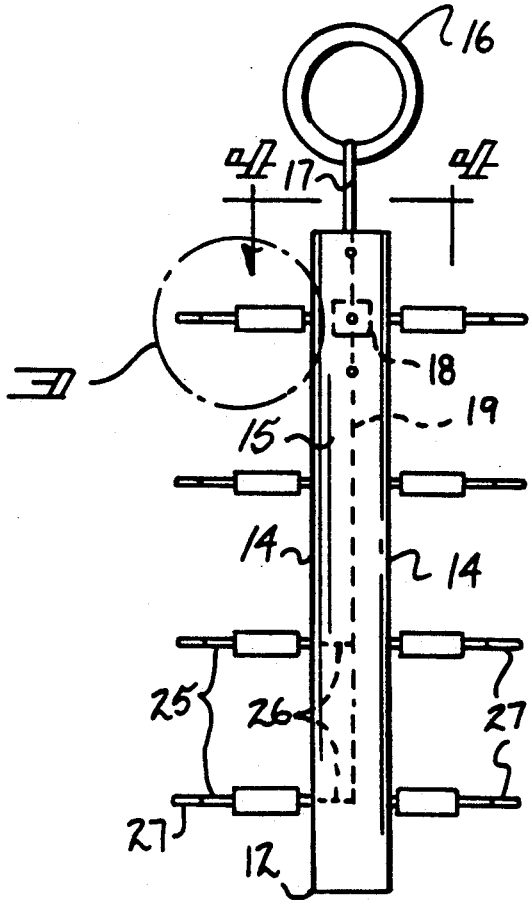

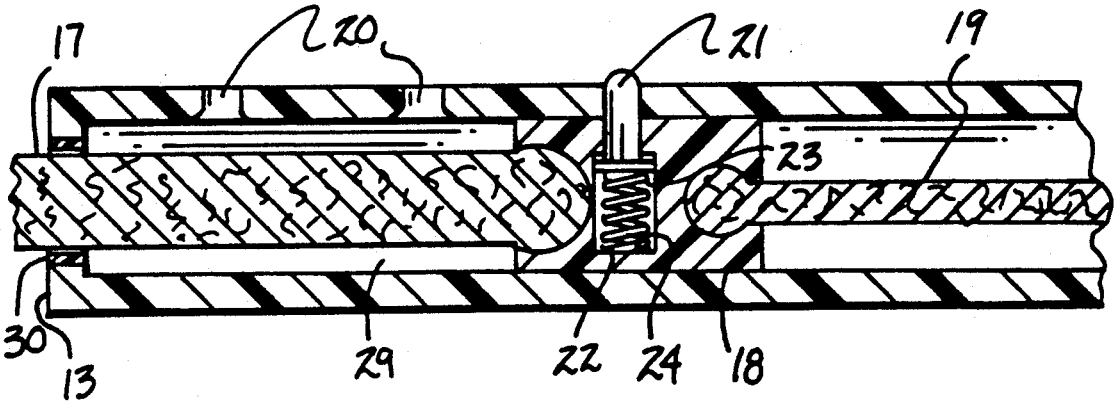
FIG 6
FIG 7
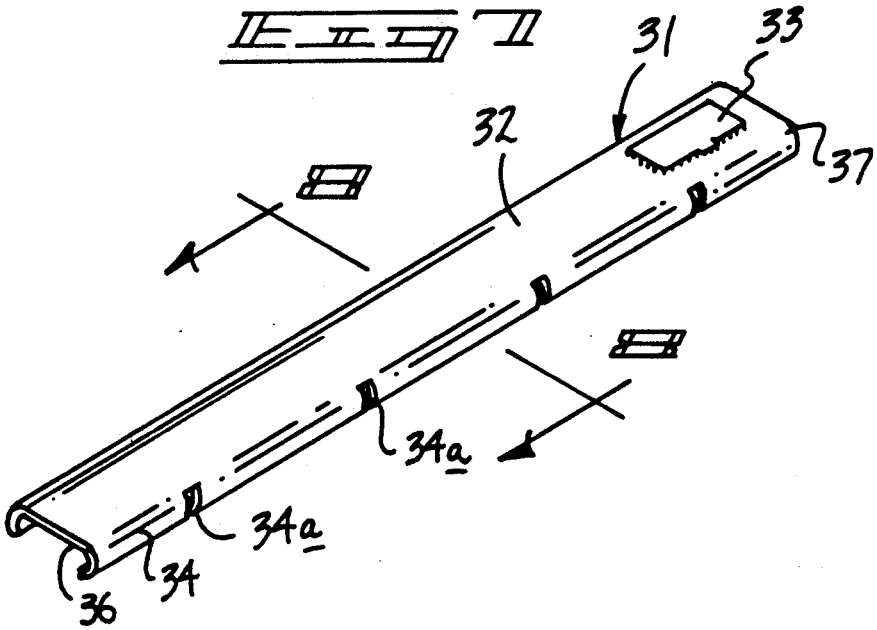

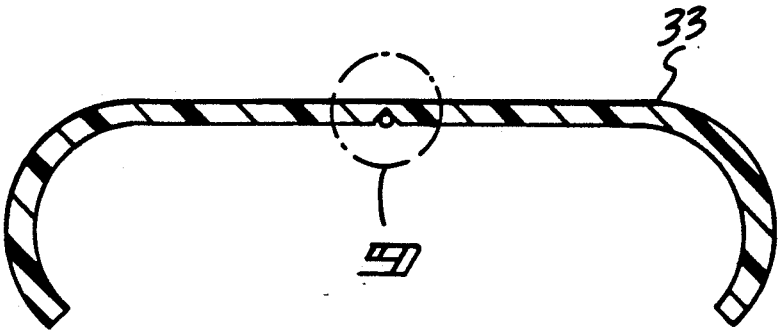
FIG 8
FIG 9
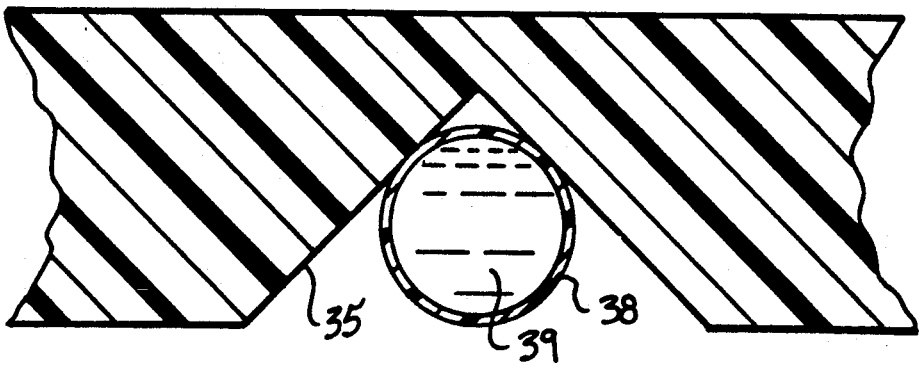

SHOE LACING APPARATUS

BACKGROUND OF THE INVENTION

1. Field of the Invention

The field of invention relates to lacing apparatus, and more particularly pertains to a new and improved shoe lacing apparatus wherein the same is directed for the rapid lacing of shoes with a unitary motion.

2. Description of the Prior Art

Shoe lacing apparatus and shoe lacing of various types are available in the prior art and examples of such structure are set forth in U.S. Pat. Nos. 4,967,454; 4,991,273; 3,500,508; 5,027,482; and 4,870,761.

The instant invention attempts to overcome deficiencies of the prior art by employing a housing structure positioned within a shoe between the shoe lacing apertures of the shoe, wherein a unitary pull rod of the organization effects immediate lacing of a shoe structure and in this respect, the present invention substantially fulfills this need.

SUMMARY OF THE INVENTION

In view of the foregoing disadvantages inherent in the known types of shoe lacing apparatus now present in the prior art, the present invention provides a shoe lacing apparatus wherein the same employs a pull rod structure to effect rapid tensioning of opposed shoe lacing openings of an associated shoe structure. As such, the general purpose of the present invention, which will be described subsequently in greater detail, is to provide a new and improved shoe lacing apparatus which has all the advantages of the prior art shoe lacing apparatus and none of the disadvantages.

To attain this, the present invention provides a shoe lacing apparatus including an elongate housing having a pull rod structure directed therethrough, with the pull rod in operative association with lateral hook members, with each hook member directed into a shoe lace opening of an associated shoe, whereupon tensioning of the pull rod and latching within the elongate housing effects the rapid lacing of the shoe structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shoe lacing apparatus which has all the advantages of the prior art shoe lacing apparatus and none of the disadvantages.

It is another object of the present invention to provide a new and improved shoe lacing apparatus which may be easily and efficiently manufactured and marketed.

It is a further object of the present invention to provide a new and improved shoe lacing apparatus which is of a durable and reliable construction.

An even further object of the present invention is to provide a new and improved shoe lacing apparatus which is susceptible of a low cost of manufacture with regard to both materials and labor, and which accordingly is then susceptible of low prices of sale to the consuming public, thereby making such shoe lacing apparatus economically available to the buying public.

Still yet another object of the present invention is to provide a new and improved shoe lacing apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the invention mounted within a shoe structure.

FIG. 2 is an enlarged orthographic view of the apparatus.

FIG. 6 is an orthographic view, taken along the lines 6—6 of FIG. 4 in the direction indicated by the arrows.

FIG. 7 is an isometric illustration of the cover housing arranged for use by the invention.

FIG. 8 is an orthographic view, taken along the lines 8—8 of FIG. 7 in the direction indicated by the arrows.

FIG. 9 is an enlarged orthographic view of section 9 as set forth in FIG. 8.

DESCRIPTION OF THE PREFERRED EMBODIMENT

Figure 3:
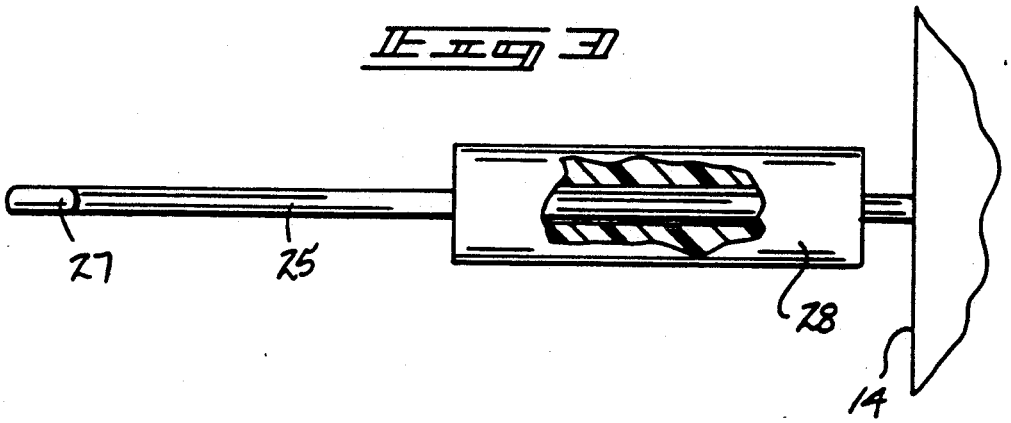
FIG. 3 is an enlarged orthographic view, partially in section, of section 3 as set forth in FIG. 2.
Figure 5:
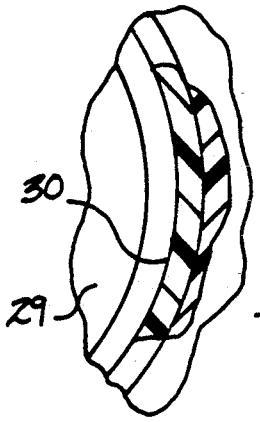
FIG. 5 is an enlarged orthographic view, partially in section, of section 5 as set forth in FIG. 4.
Figure 4:
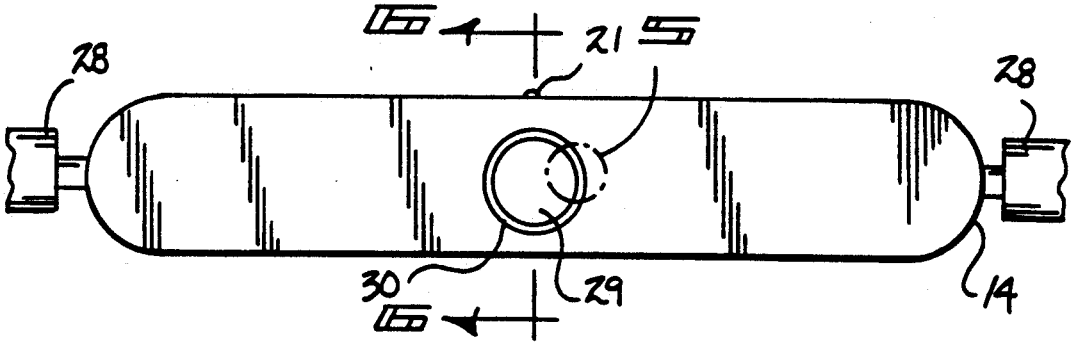
FIG. 4 is an orthographic view, taken along the lines 4—4 of FIG. 2 in the direction indicated by the arrows.

With reference now to the drawings, and in particular to FIGS. 1 to 9 thereof, a new and improved shoe lacing apparatus embodying the principles and concepts of the present invention and generally designated by the reference numeral 10 will be described.

More specifically, the shoe lacing apparatus 10 of the instant invention essentially comprises an elongate housing 11, having a housing first end 12 spaced from a housing second end 13, with spaced parallel housing side walls 14 and a housing top wall 15. A pull ring 16 is provided mounted fixedly to a first pull rod 17 directed longitudinally through the elongate housing 11 slidably mounted through a housing bore 29, having a slide tube 30, as indicated in the FIGS. 4 and 5. With reference to FIG. 6, the pull ring 16 is mounted to a first pull rod 17 into the housing bore 29, with the first pull rod 17 mounted to a slide block 18 within the housing bore. A second pull rod 19 longitudinally aligned with the first pull rod 17 is directed through the housing bore, with the second pull rod 19 having plural rows of hook rods 25 mounted to the second pull rod, with each of the hook rods 25 projecting through one of the side walls 14. Each of the side walls 14 includes a row of the hook rods 25 spaced apart a predetermined spacing, with each hook rod 25 having a hook rod first end 26 mounted to the second pull rod 19, with each hook rod 25 having a second hook rod end 27 having a hook member thereon arranged for reception through one of the shoe lace openings of the associated shoe structure, as indicated in FIG. 1.

A row of top wall apertures 20 are positioned medially of the housing top wall 15 intermediate the side walls 14, with the slide block 18 having a slide block cavity 23 and a slide block cavity floor 24 spaced below the housing top wall 15. Within the slide block cavity 23 is mounted a spring 22, with a detent rod 21 capturing the spring 22 between the detent rod 21 and the slide block cavity floor 24 biasing the detent rod 21 and projecting the detent rod through one of the top wall apertures 20 to effect selective latching of the slide block relative to the elongate housing 11. To permit delatching of the structure, the detent rod 21 is merely projected manually into the housing bore 29. In this manner, upon pulling of the pull ring 16 and tensioning of the first and second pull rods 17 and 19, tensioning of each of the hook rods 25 is effected to provide for rapid lacing of the shoe as the opposed rows of shoe lace openings are directed towards one another.

It should be further noted that each of the hook rods 25 includes a guide block 28 mounted between the hook rod second end and a side wall 14 of the housing 11, wherein the guide block 28 slidably receives the hook rod 25 therethrough to provide for spacing of the hook rod second ends 27 relative to the housing side walls 14 in the tensioning of the opposed sides of the shoe apertured portions, as indicated in FIG. 1.

The FIGS. 7–9 indicates the use of an optical cover housing 31 provided by the invention to afford the changing of colors of the invention, as well as affording protection to the detent rod 21. In this manner, various cover housings may be employed for mounting upon the elongate housing 11, and more specifically, onto the elongate housing top wall 15. The cover housing 31 includes a cover housing top wall 32, including a top wall door 33 for access to the detent rod 21 and the underlying top wall apertures 20 of the elongate housing 11. The cover housing includes cover housing spaced side walls 34 of arcuate construction arranged to receive the elongate housing side walls 14, with each of the cover housing side walls including slots **34*a* spaced apart the predetermined spacing to receive the hook rods 25 therethrough. The cover housing 31 provided with a cover housing first end and a cover housing second end 36 and 37 respectively includes an elongate pivot groove 35 extending coextensively between the cover housing first and second ends, with a pivot groove 35 directed through a bottom surface of the cover housing top wall 32, having a frangible glue capsule 38 (see FIG. 9) having an adhesive 39 therewithin. In this manner, pivoting the cover housing top wall 32 about the pivot groove 35 effects crushing of the glue capsule 38 and the directing of the associated adhesive 39 onto the elongate housing top wall 15 to bond the cover housing 31 to the housing 11 for a permanent association of the cover housing 31 relative to the elongate housing 11**.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shoe lacing apparatus for directing opposed shoe lace apertures of an associated shoe together, comprises:

an elongate housing, with the elongate housing having a housing first end and a housing second end, a housing top wall and spaced housing side walls, and the housing having a housing bore directed into the housing first end oriented longitudinally of the housing intermediate the housing side walls, and a pull ring, the pull ring positioned exteriorly of the housing adjacent the housing first end, and a first pull rod mounted to the pull ring and extending into the housing bore through the housing first end, and a slide block slidably mounted within the housing intermediate the housing first end and the housing second end, with the first pull rod mounted to the slide block, and the slide block including a second pull rod, the second pull rod longitudinally aligned with the first pull rod and extending from the slide block through the elongate housing intermediate the housing side walls, and the slide block having latch means cooperative with the housing top wall for selective latching of the slide block relative to the housing top wall, and the second pull rod having a plurality of hook rods directed from the second pull rod through each of the side walls, wherein the pull rods are spaced apart a predetermined spacing along each of the side walls, and each of the hook rods includes a hook rod first end mounted to the second pull rod, and each hook rod having a hook rod second hook end having a hook, with each hook arranged for reception within one of the shoe lace openings of said shoe, and manual pulling of the pull ring effects pulling and tensioning of the hook rods within the housing, wherein each hook rod is formed of a flexible material.

2. An apparatus as set forth in claim 1 wherein said latch means includes a slide block cavity directed into the slide block, with the slide block cavity having a slide block cavity floor spaced below and in a facing relationship relative to the housing top wall, and the latch means further including a detent rod mounted within the slide block cavity, with the detent rod having a spring member captured between the detent rod and the slide block cavity floor, and the elongate housing top wall including a row of top wall apertures, with the detent rod arranged for reception through one of the top wall apertures.

3. An apparatus as set forth in claim 2 wherein each of the hook rods includes a guide block positioned between each hook rod second hook end and one of said housing side walls, wherein each guide block slidably receives the hook rod therethrough.

4. An apparatus as set forth in claim 3 including a cover housing, the cover housing including a cover housing top wall, with the cover housing top wall including a top wall door arranged for positioning in adjacency to the top wall apertures of the elongate housing top wall, and the cover housing including cover housing side wall slots spaced apart a predetermined spacing along each of the cover housing side walls, wherein each side wall slot of said side wall slots is arranged to receive one of said hook rods therethrough.

5. An apparatus as set forth in claim 4 wherein the cover housing includes a cover housing first end and a cover housing second end, and the cover housing having a pivot groove directed between the cover housing first end and cover housing second end intermediate the cover housing side walls, and the pivot groove including a frangible glue capsule positioned within the pivot groove, with the glue capsule having an adhesive therewithin, whereupon pivoting of the cover housing top wall about the pivot groove effects capturing of the glue capsule to direct the adhesive between the elongate housing top wall and the cover housing.

* * * * *